US007775736B2

(12) United States Patent
Song

(10) Patent No.: US 7,775,736 B2
(45) Date of Patent: Aug. 17, 2010

(54) PORTABLE CONVERSION WASHING DEVICE

(76) Inventor: James In Song, 7891 Barbi Ln., La Palma, CA (US) 90623

( * ) Notice: Subject to any disclaimer, the term of this patent is extended or adjusted under 35 U.S.C. 154(b) by 617 days.

(21) Appl. No.: 11/675,506

(22) Filed: Feb. 15, 2007

(65) Prior Publication Data

US 2008/0199244 A1 Aug. 21, 2008

(51) Int. Cl.
*A46B 11/04* (2006.01)
*A47L 13/22* (2006.01)

(52) U.S. Cl. ..... 401/279; 401/278; 401/289; 401/274; 401/273; 401/272; 401/270; 401/268; 401/137

(58) Field of Classification Search ..... 401/289, 401/285, 270–275, 277–279, 286, 136–139, 401/203–204, 263–264, 282, 148; 239/530, 239/532

See application file for complete search history.

(56) References Cited

U.S. PATENT DOCUMENTS 2,417,370 A * 3/1947 Magann et al. ..... 401/279
3,694,097 A * 9/1972 Fedorek ..... 401/206
4,312,598 A * 1/1982 Vagner ..... 401/1
4,717,180 A * 1/1988 Roman ..... 285/148.19
4,720,883 A * 1/1988 Sanchez ..... 401/289
5,110,231 A * 5/1992 Monteith et al. ..... 401/190
6,336,764 B1 * 1/2002 Liu ..... 401/289
6,394,682 B1 * 5/2002 Zhadanov et al. ..... 401/289
6,595,439 B1 * 7/2003 Chen ..... 239/225.1
6,786,431 B2 * 9/2004 Song ..... 239/526
6,848,384 B2 * 2/2005 Higgins et al. ..... 15/144.1
6,935,579 B1 * 8/2005 Lindsey ..... 239/530
7,001,095 B1 * 2/2006 Chen ..... 401/289
D521,242 S * 5/2006 Gaiti ..... D4/115

* cited by examiner

*Primary Examiner*—David J. Walczak
*Assistant Examiner*—Keegan Gumbs
(74) *Attorney, Agent, or Firm*—John K. Park; Park Law Firm

(57) ABSTRACT

A portable conversion washing device includes a pole, a brush support having a soap container, a brush, and a soap dispensing device that has a soap plug that plugs a dispensing opening, an actuator that moves the soap plug away from the dispensing opening whereby soap is dispensed out of the soap container, and a return device that moves the soap plug back to the dispensing opening. The washing device also includes a running water supply device having a first pipe connected to a running water supply hose, a second pipe that is in fluid communication with the first pipe, an angle adjusting device that adjust the angle between the first pipe and the second pipe. The second pipe has a tapered water conduit, a water flow plug that is moved along the conduit, and a water flow shaft that moves the water flow plug within the conduit.

4 Claims, 4 Drawing Sheets

PORTABLE CONVERSION WASHING DEVICE

BACKGROUND OF THE INVENTION

The present invention relates to a portable conversion washing device.

More particularly, this invention relates to a portable conversion washing device which controls the soap flow from the soap container to the brush.

Also, the invention relates to a portable conversion washing device which adjusts the water flow amount of the washing device.

A brush with a long shaft makes it possible to clean surfaces without crouching over the surface. Since the brush is provided at an end of a long shaft, however, it is challenging to control the amount of soap (and water) applied to the brush. Some of the prior art provided a device to do the job, but there were several problems.

The string from the soap lever to the soap container ran exposed outside of the shaft, which is very inconvenient and bothersome to the work.

Originally the trouble of the exposed string was originated from the difficulty to control the length of the shaft along with the length of the string itself.

Accordingly, a need for a portable conversion washing device has been present for a long time considering the wide range of use. This invention is directed to solve these problems and satisfy the long-felt need.

SUMMARY OF THE INVENTION

The present invention contrives to solve the disadvantages of the prior art.

An object of the invention is to provide a portable conversion washing device that can dispense soap with simple and reliable mechanism.

Another object of the invention is to provide a portable conversion washing device that can supply running water in controlled amount and spraying direction.

In order to achieve the objects, the present invention provides a portable conversion washing device that comprises a pole comprising a first end, a second end, and a side portion, a brush support that comprises a hollow interior portion having a soap container, and is connected to the first end of the pole, a brush provided at the front edge of the brush support and comprises a plurality of bristles, and a soap dispensing device that dispenses predetermined amount of soap out of the soap container.

The soap container comprises a fill-in opening and a dispensing opening. The soap dispensing device comprises a soap plug that plugs the dispensing opening, an actuator that moves the soap plug away from the dispensing opening whereby soap is dispensed out of the soap container, and a return device that moves the soap plug back to the dispensing opening.

The soap plug comprises a plug body. The actuator comprises a rod that is extended from the plug body and passes through the dispensing opening.

The return device comprises an inner shaft, a hollow outer shaft that receives the inner shaft, a bracket that fixes the inner shaft to the brush support and a compression spring that is positioned between the soap plug and the bracket. The inner shaft moves back and forth inside the outer shaft. The dispensing opening comprises step on which the soap plug rests. The bracket is fixed to the brush support near the fill-in opening.

The soap plug comprises a plug body, a plug leg and a plug brace that connects the plug leg to the plug body so that that the plug leg is spaced from the plug body by a predetermined distance. The plug leg comprises a plug slant portion. The actuator comprises a side shaft that comprises an outer end that extends outside the brush support through a side opening provided on the brush support and an inner end. The inner end comprises a side slant portion that engages with the plug slant portion, whereby moving the side shaft inward moves the side slant portion inward, which in turn moves the plug slant portion upward, thus moving the soap plug away from the dispensing opening.

The return device comprises a flange provide on the side shaft, a side shaft bracket that receives the side shaft and is fixed inside the brush support and a compression spring provided between the flange and the side shaft bracket.

The portable conversion washing device further includes a running water supply device that comprises a first pipe that is adapted to be connected to a running water supply hose and that is connected to the second end of the pole, a second pipe that is in fluid communication with the first pipe, and a angle adjusting device that adjust the angle between the first pipe and the second pipe.

The angle adjusting device comprises a first angle end that extends from the first pipe, a second angle end that extends from the second pipe, and a fastening device that fastens the first angle end and the second angle at a given angle.

The first angle end comprises a first circular hole and the second angle end comprises a second circular hole. The angle adjusting device comprises a first engaging portion that surrounds the first circular hole and a second engaging portion that surrounds the second circular hole. Each of engaging portions has a plurality of convex portions and concave portions between the convex portions. The convex portions of the first engaging portion engage with the concave portions of the second engaging portion.

The second pipe comprises a tapered water conduit. The running water supply device further comprises a water flow adjusting device that comprises a water flow plug that is moved along the tapered water conduit, and a water flow shaft that moves forward and backward within the water conduit. The water plug is fixed to the water flow shaft.

The advantages of the present invention are: (1) dispensing of soap is convenient since a user simply can push the brush head on the ground or make the side shaft hit a hard object like a wall; and (2) a user can adjust the direction and flow rate of water spray.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

The U.S. Pat. No. 6,786,431 and U.S. patent application Ser. No. 11/308,761 by the inventor are incorporated by reference into this disclosure as if fully set forth herein.

Figure 1:
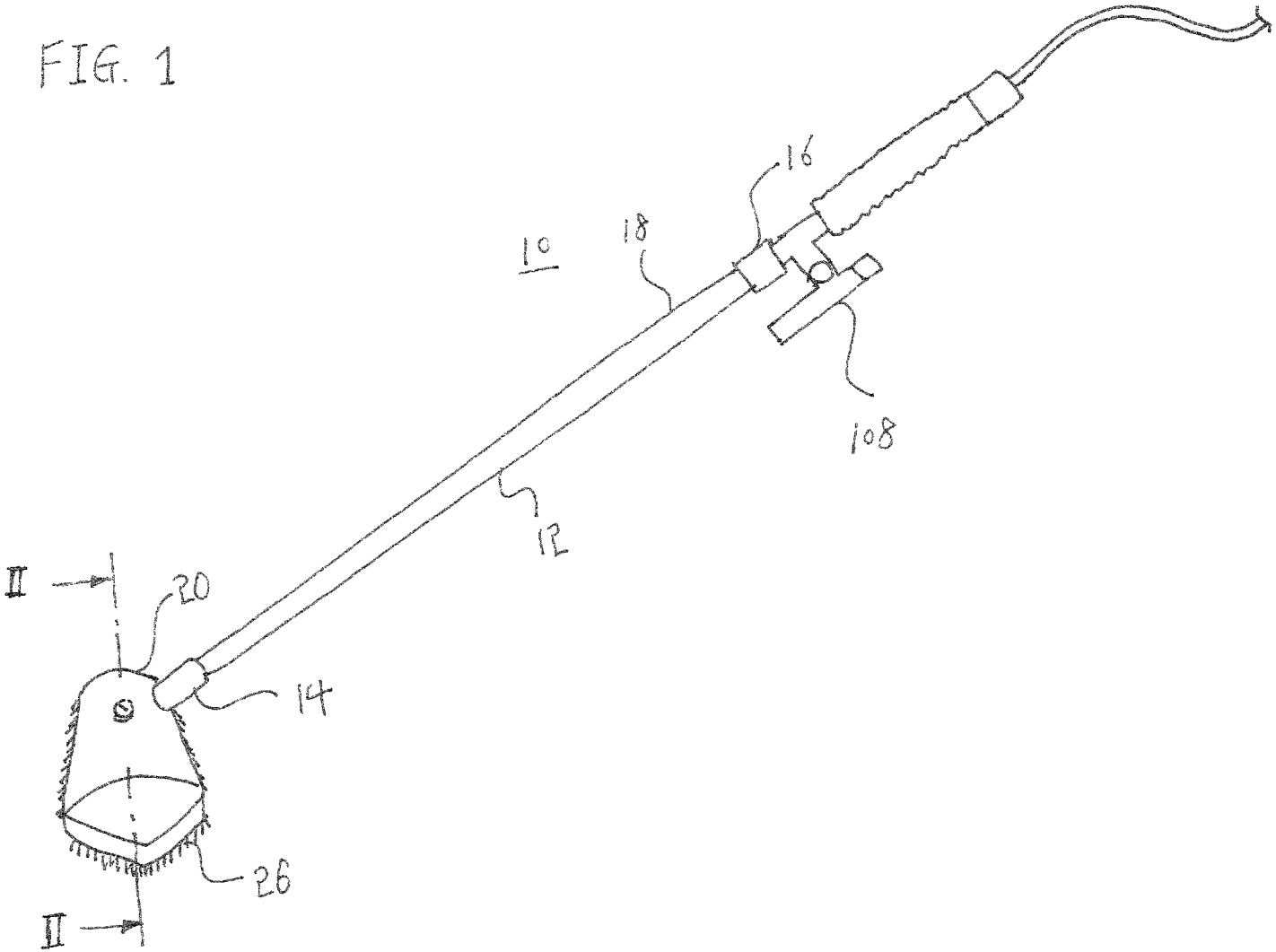
FIG. 1 is a perspective view showing a conversion washing device according to the present invention.

FIG. 1 shows a portable conversion washing device 10 that comprises a pole 12 comprising a first end 14, a second end 16, and a side portion 18, a brush support 20 that comprises a hollow interior portion 22 having a soap container 24 (refer to FIG. 2), and is connected to the first end 14 of the pole 12, a brush 26 provided at the brush support 20 and comprises a plurality of bristles 28, and a soap dispensing device 30 that dispenses predetermined amount of soap out of the soap container 24.

Figure 2:
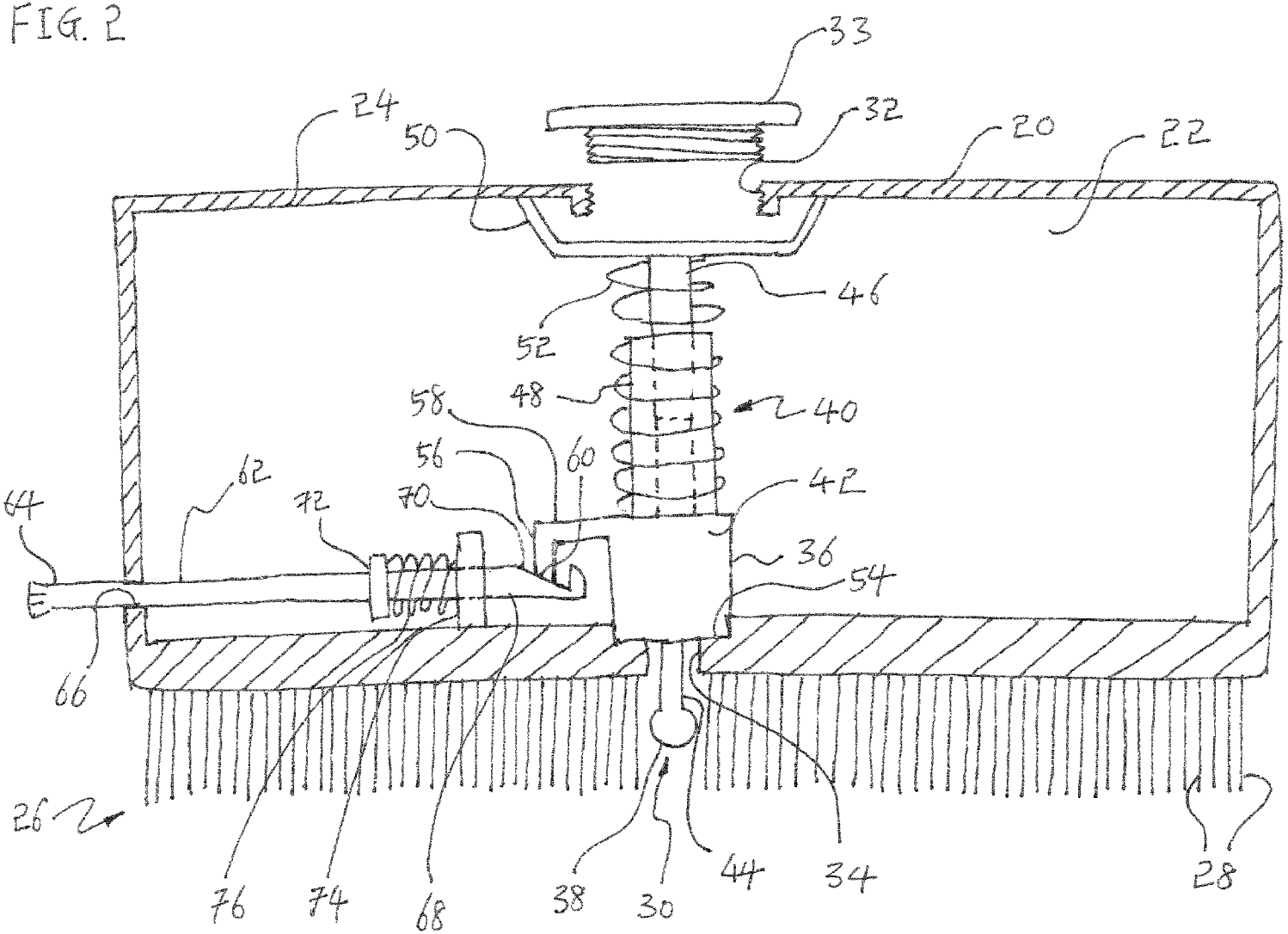
FIG. 2 is a cross-sectional view taken along line II-II in FIG. 1.
Figure 3:
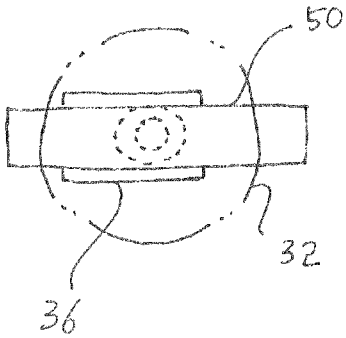
FIG. 3 is a plan view showing a bracket.
Figure 4:
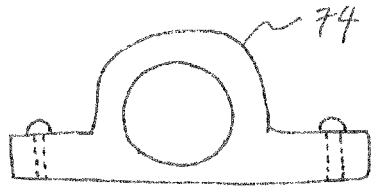
FIG. 4 is an elevation view showing a side bracket.
Figure 6:
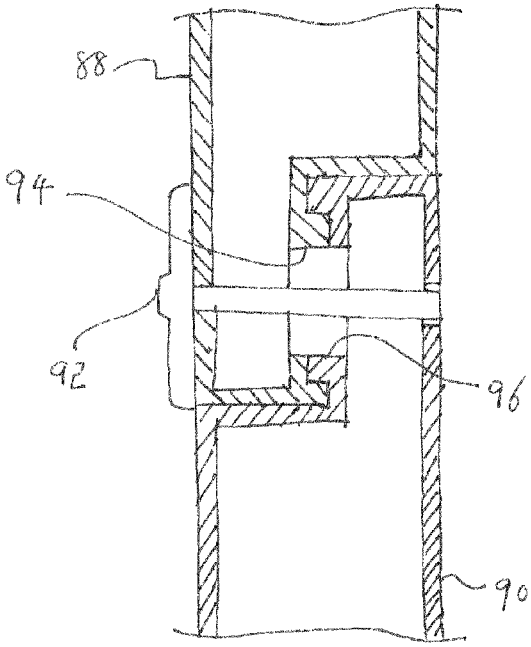
FIG. 6 is an elevation view showing the running water supply device.
Figure 7:
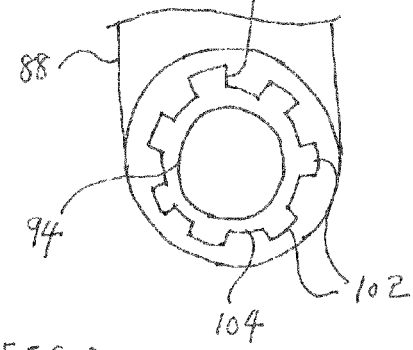
FIG. 7 is an elevation view showing a first angle end of an angle adjusting device.
Figure 8:
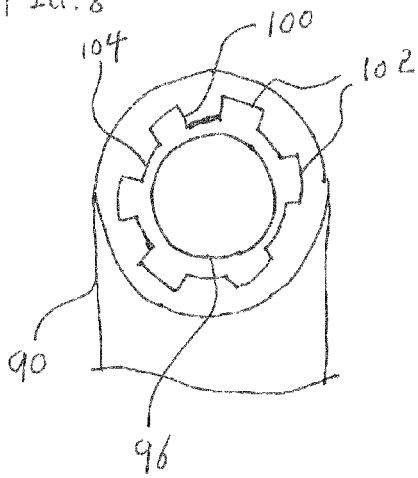
FIG. 8 is an elevation view showing a second angle end of the angel adjusting device.

FIG. 2 shows that the soap container 24 comprises a fill-in opening 32, a fill-in opening cap 33 and a dispensing opening 34. The soap dispensing device 30 comprises a soap plug 36 that plugs the dispensing opening 34, an actuator 38 that moves the soap plug 36 away from the dispensing opening 34 whereby soap is dispensed out of the soap container 24, and a return device 40 that moves the soap plug 36 back to the dispensing opening 34.

The soap plug 36 comprises a plug body 42. The actuator 38 comprises a rod 44 that is extended from the plug body 42 and passes through the dispensing opening 34.

The return device 40 comprises an inner shaft 46, a hollow outer shaft 48 that receives the inner shaft 46, a bracket 50 that fixes the inner shaft 46 to the brush support 20 and a compression spring 52 that is positioned between the soap plug 36 and the bracket 50. The inner shaft 46 moves back and forth inside the outer shaft 48. The dispensing opening 34 comprises a step 54 on which the soap plug 36 rests. The bracket 50 is fixed to the brush support 20 near the fill-in opening 32. In order to dispense soap, a user simply pushes the brush head 20 on a hard surface like the floor so that the rod 44 is pushed.

The soap dispensing device 30 can also be operated from the side of the brush support 20. The soap plug 36 further comprises a plug leg 56 and a plug brace 58 that connects the plug leg 56 to the plug body 42 so that that the plug leg 56 is spaced from the plug body 42 by a predetermined distance. The plug leg 56 comprises a plug slant portion 60. The actuator 38 comprises a side shaft 62 that comprises an outer end 64 that extends outside the brush support 20 through a side opening 66 provided on the brush support 20 and an inner end 68. The inner end 68 comprises a side slant portion 70 that engages with the plug slant portion 60, whereby moving the side shaft 62 inward moves the side slant portion inward 70, which in turn moves the plug slant portion upward 60, thus moving the soap plug 36 away from the dispensing opening 34.

The return device 40 comprises a flange 72 provided on the side shaft 62, a side shaft bracket 74 that receives the side shaft 62 and is fixed inside the brush support 20 and a compression spring 76 provided between the flange 72 and the side shaft bracket 74. In order to dispense soap, a user make the side shaft 62 be pushed, for example by hitting the side of the brush head against a wall.

Figure 5:
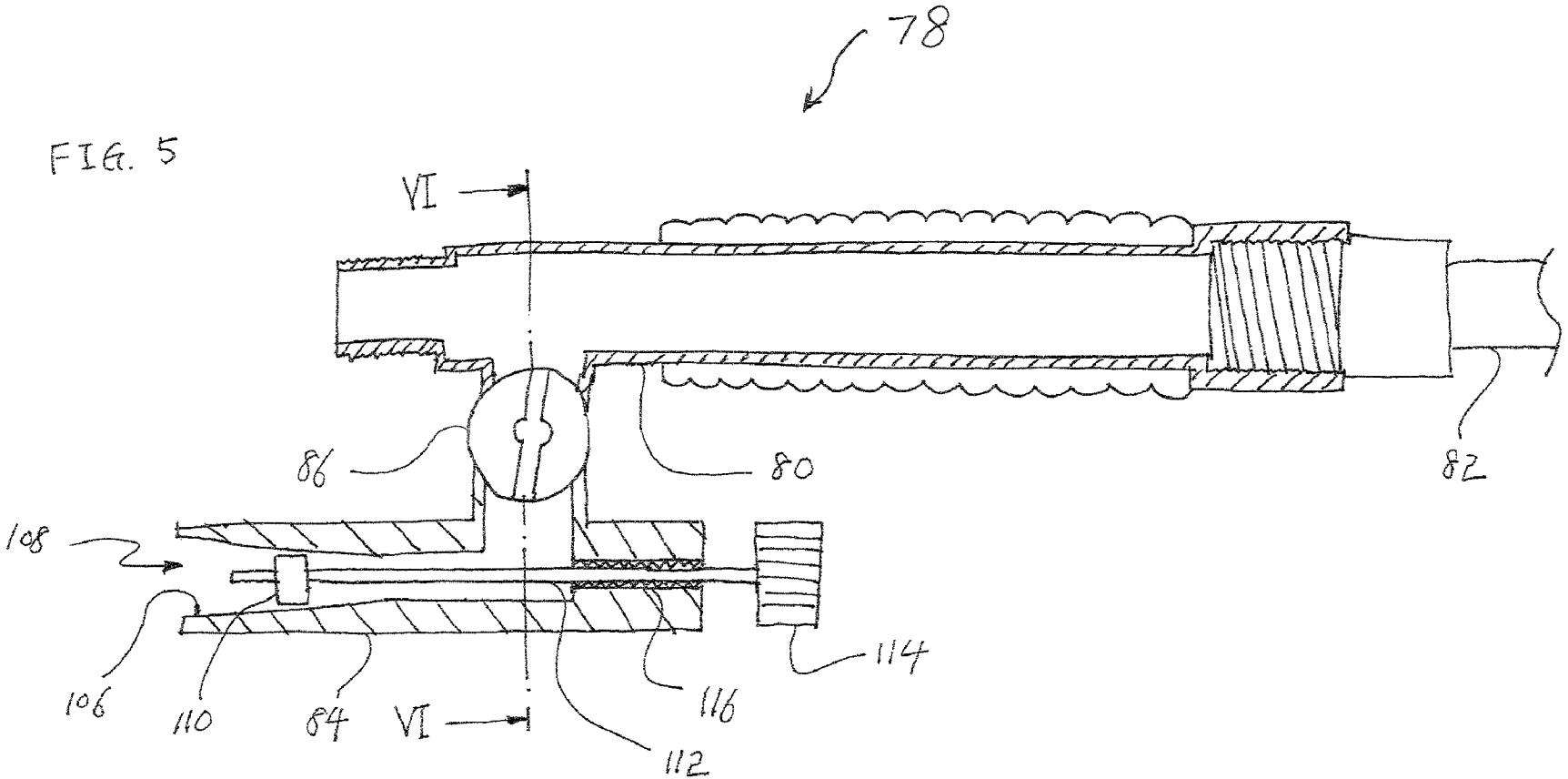
FIG. 5 is a cross-sectional view showing a running water supply device.

FIG. 5 shows that the portable conversion washing device 10 further includes a running water supply device 78 that comprises a first pipe 80 that is adapted to be connected to a running water supply hose 82 and that is connected to the second end 16 of the pole 12, a second pipe 84 that is in fluid communication with the first pipe 80, and a angle adjusting device 86 that adjust the angle between the first pipe 80 and the second pipe 84.

The angle adjusting device 86 comprises a first angle end 88 that extends from the first pipe 80, a second angle end 90 that extends from the second pipe 84, and a fastening device 92 that fastens the first angle end 88 and the second angle end 90 at a given angle.

The first angle end 88 comprises a first circular hole 94 and the second angle end 90 comprises a second circular hole 96. The angle adjusting device 86 comprises a first engaging portion 98 that surrounds the first circular hole 94 and a second engaging portion 100 that surrounds the second circular hole 96. Each of engaging portions has a plurality of convex portions 102 and concave portions between the convex portions 104. The convex portions 102 of the first engaging portion 98 engage with the concave portions 104 of the second engaging portion 100.

Referring back to FIG. 5, the second pipe 84 comprises a tapered water conduit 106. The running water supply device 78 further comprises a water flow adjusting device 108 that comprises a water flow plug 110 that is moved along the tapered water conduit 106, and a water flow shaft 112 that moves forward and backward within the water conduit 106. The water plug 110 is fixed to the water flow shaft 112. The water plug is moved by rotating the water flow shaft 112, which is threaded, in a threaded opening 116 in the second pipe 84 with a knob 114.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A portable conversion washing device comprising:

a) a pole comprising a first end, a second end, and a side portion;

b) a brush support that comprises a hollow interior portion, wherein the interior portion comprises a soap container, wherein the brush support is connected to the first end of the pole;

c) a brush provided at the brush support, wherein the brush comprises a plurality of bristles; and d) a soap dispensing device that dispenses predetermined amount of soap out of the soap container;

wherein the soap container comprises a fill-in opening and a dispensing opening, wherein the soap dispensing device comprises a soap plug that plugs the dispensing opening, an actuator that moves the soap plug away from the dispensing opening whereby soap is dispensed out of the soap container, and a return device that moves the soap plug back to the dispensing opening, the portable conversion washing device further comprising a running water supply device that comprises a first pipe that is adapted to be connected to a running water supply hose and that is connected to the second end of the pole, a second pipe that is in fluid communication with the first pipe, and an angle adjusting device that adjusts the angle between the first pipe and the second pipe, wherein the second pipe comprises a tapered water conduit, wherein the running water supply device further comprises a water flow adjusting device that comprises a water flow plug that is moved along the tapered water conduit, and a water flow shaft that moves forward and backward within the water conduit, wherein the water plug is fixed to the water flow shaft, wherein the soap plug comprises a plug body, a plug leg and a plug brace that connects the plug leg to the plug body so that the plug leg is spaced from the plug body by a predetermined distance, wherein the plug leg comprises a plug slant portion, wherein the actuator comprises a side shaft that comprises an outer end that extends outside the brush support through a side opening provided on the brush support and an inner end, wherein the inner end comprises a side slant portion that engages with the plug slant portion, whereby moving the side shaft inward moves the side slant portion inward, which in turn moves the plug slant portion upward, thus moving the soap plug away from the dispensing opening.

2. The portable conversion washing device of claim 1, wherein the return device comprises a flange provided on the side shaft, a side shaft bracket that receives the side shaft and is fixed inside the brush support and a compression spring provided between the flange and the side shaft bracket.

3. A portable conversion washing device comprising:

a) a pole comprising a first end, a second end, and a side portion;

b) a brush support that comprises a hollow interior portion, wherein the interior portion comprises a soap container, wherein the brush support is connected to the first end of the pole;

c) a brush provided at the brush support, wherein the brush comprises a plurality of bristles; and d) a soap dispensing device that dispenses predetermined amount of soap out of the soap container;

wherein the soap container comprises a fill-in opening and a dispensing opening, wherein the soap dispensing device comprises a soap plug that plugs the dispensing opening, an actuator that moves the soap plug away from the dispensing opening whereby soap is dispensed out of the soap container, and a return device that moves the soap plug back to the dispensing opening, the portable conversion washing device further comprising a running water supply device that comprises a first pipe that is adapted to be connected to a running water supply hose and that is connected to the second end of the pole, a second pipe that is in fluid communication with the first pipe, and an angle adjusting device that adjusts the angle between the first pipe and the second pipe, wherein the second pipe comprises a tapered water conduit, wherein the running water supply device further comprises a water flow adjusting device that comprises a water flow plug that is moved along the tapered water conduit, and a water flow shaft that moves forward and backward within the water conduit, wherein the water plug is fixed to the water flow shaft, wherein the angle adjusting device comprises a first angle end that extends from the first pipe, a second angle end that extends from the second pipe, and a fastening device that fastens the first angle end and the second angle end at a given angle.

4. The portable conversion washing device of claim 3, wherein the first angle end comprises a first circular hole and the second angle end comprises a second circular hole, wherein the angle adjusting device comprises a first engaging portion that surrounds the first circular hole and a second engaging portion that surrounds the second circular hole, wherein each of engaging portions has a plurality of convex portions and concave portions between the convex portions, wherein the convex portions of the first engaging portion engage with the concave portions of the second engaging portion.

* * * * *